US006415637B1

(12) United States Patent
Wittwer

(10) Patent No.: US 6,415,637 B1
(45) Date of Patent: Jul. 9, 2002

(54) CLOSING DEVICE WITH A KEY OPERABLE CLOSING CYLINDER WHICH SIMULTANEOUSLY SERVES AS A HAND OPERATED PUSHING DEVICE FOR OPERATING LOCKING ELEMENTS

(75) Inventor: Reinhard Wittwer, Heiligenhaus (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 09/529,160

(22) PCT Filed: Sep. 3, 1998

(86) PCT No.: PCT/EP98/05595

§ 371 (c)(1),
(2), (4) Date: Apr. 6, 2000

(87) PCT Pub. No.: WO99/20861

PCT Pub. Date: Apr. 29, 1999

(30) Foreign Application Priority Data

Oct. 21, 1997 (DE) ..... 197 46 381

(51) Int. Cl.[7] ..... E05B 63/00; E05B 65/00
(52) U.S. Cl. ..... 70/264
(58) Field of Search ..... 70/264, 262, 263

(56) References Cited

U.S. PATENT DOCUMENTS 5,121,527 A * 6/1992 Righi ..... 24/602
5,216,908 A * 6/1993 Malvy ..... 70/218

FOREIGN PATENT DOCUMENTS

| | | |
|---|---|---|
| DE | 4408910 | 9/1995 |
| GB | 2200397 | 10/1988 |

* cited by examiner

*Primary Examiner*—Yonel Beaulieu
(74) *Attorney, Agent, or Firm*—Friedrich Kueffner

(57) ABSTRACT

A closing device has a key-operable closing cylinder which is simultaneously a component of a pusher and serves as a hand-operated thrusting device for operating locking elements. A central locking system can be used to actuate a lever with a drive. Malfunctions result when the central locking lever, moved to a secured position by the drive of the central locking system, blocks the components in the closing cylinder such that the key cannot be inserted into the closing cylinder when a pushing arm which is rotated by the closing cylinder is in an inactive position and blocked. This is avoided by using coupling elements which are provided between the supporting points of the lever allocated to the central locking system and also between the supporting points of the pushing arm. In accordance with the rotated position of the key in the closing cylinder, the coupling elements change between coupling and uncoupling positions. The lever is uncoupled when the pushing arm is in the inactive position. Accordingly, movement of the lever ceases, this movement caused by the drive of the central locking system, thus preventing engagement of the pushing arm.

15 Claims, 6 Drawing Sheets

CLOSING DEVICE WITH A KEY OPERABLE CLOSING CYLINDER WHICH SIMULTANEOUSLY SERVES AS A HAND OPERATED PUSHING DEVICE FOR OPERATING LOCKING ELEMENTS

BACKGROUND OF THE INVENTION

1. Field of the Invention

The invention relates to a closing device of the type specified in the preamble of claim 1. The closing cylinder is a component of a pusher which comprises further components. Similar to the way in which a closing cylinder can be divided into a cylinder core and a cylinder guide, this division is continued in the pusher, and this is why one can refer to radially inner core parts and radially outer sleeve parts of the pusher.

2. Description of the Related Art

In the known closing device of this kind (DE 44 08 910 A1) a pusher base is rotatably supported at the inner end of the pusher and is axially moved upon pushing. The actuation of the locking elements is realized by a pusher arm which is provided on a pusher base and upon axial pushing movement of the pusher contacts a first locking element and moves it. The core parts of the pusher are fixedly connected for common rotation to the pusher base and can be switched by the key between two rotational positions. In the known device these result in two differently acting angular positions of the pusher arm, i.e., one position aligned with the first locking element and thus active during pushing and one non-aligned position that is inactive during pushing. This device has been successfully used; however, there are problems when this device is to be used together with a central locking device which in the following is shortly referred to as "CL device".

A CL device is desirable when the present locking device is to be controlled together with further locking devices. This is necessary when the device mentioned in the preamble of claim 1 is arranged at the rear of a vehicle and further locking devices are provided at the doors of the vehicle which have their own locks. Then a CL device is used acting on a CL lever in each one of the different locking devices and switching it between two pivot positions, i.e., a secure position in which the CL device acts on the locks of the different locking devices such that they cannot be actuated by their respective actuator and further an unsecured position in which these locks can be actuated by their actuator.

When combining such a CL lever with the closing device mentioned in the preamble of claim 1, a lever base is to be used which belongs to the CL lever and is rotatably supported at the inner end of the pusher adjacent to the aforementioned pusher base. In such a combination with the known closing device the CL lever and the pusher arm are always synchronously movable. This results in operational disruptions in that rotational position of the core parts in which the pusher arm is in its inactive position and the CL lever is thus in its secured position. In this case, in order to avoid manipulations, the pusher base is to be blocked. When the CL device is now switched, jamming in the interior of the components of the known closing device can occur. This jamming action can result in that the key cannot be inserted into the closing cylinder. This results in considerable operational disruptions.

SUMMARY OF THE INVENTION

It is an object of the present invention to provide a reliable closing device of the aforementioned kind in which the aforementioned operational disruptions can no longer occur. This is inventively achieved by the measures characterized by the following particularities.

The pusher base which comprises the pusher arm actuating the locking elements is connected by coupling means with the lever base of the CL lever which is controlled by the CL drive. These coupling means are now activated or deactivated by the core parts of the pusher arm. In the secured position of the core parts already mentioned before in which the pusher arm is in its inactive position, the coupling means are in the decoupled position. Now the CL lever is free and can be moved by the CL drive between the secured and unsecured positions without this having an effect on a positional change of the pusher arm. The CL lever is in "free-wheeling" state. Accordingly, the aforementioned jamming of the components of the device according to the invention can no longer occur.

This is changed only when the core parts are moved by the key into their other rotational position which is referred to as the "normal position". In this case, the coupling means between the pusher base and the lever base are activated, and this provides the desired fixed connection for common rotation between the CL lever and the pusher arm.

BRIEF DESCRIPTION OF THE DRAWINGS

Further advantages of the invention result from the further claims, the following description, and the drawings. In the drawings one embodiment of the invention is represented. It is shown in:

DESCRIPTION OF PREFERRED EMBODIMENTS

Figure 1:
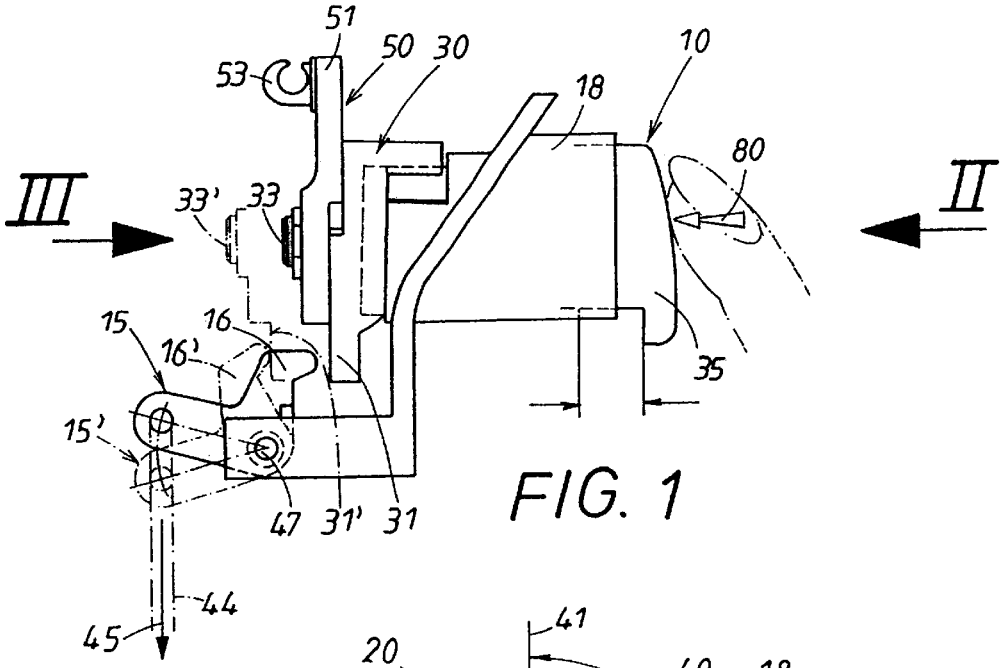
FIG. 1 a schematic side view of the device according to the invention.

The device comprises a closing cylinder 20 actuated by a key 14 which is integrated into a pusher 10 and, as shown in FIG. 1, is a pushing member for actuating the locking elements 15. The closing cylinder 20 has a conventional configuration. It is comprised first of a cylinder core 21 with lock elements 25, indicated in dash-dotted lines in FIG. 4, which are controlled by the inserted key 14. Furthermore, the closing cylinder 20 comprises a cylinder guide 22 for rotationally supporting the cylinder core 21 which has lock channels 26 etc. for the lock elements 25. Both components of the locking cylinder 20 have axial extensions 23, 24 which are also components of the pusher 10. This includes a bolt 23 fixedly connected for common rotation by an axial coupling 27 with the cylinder core 21 in a coupling state and a bolt guide 24 as an extension of the cylinder guide 22. The bolt guide 24 is forced against the end face of the cylinder guide 22 by an axial spring force of a freely moving spring 29 wherein between the end faces pressed against one another an axial leverage profile 28 is provided. Upon a forced rotation of the locking cylinder 10 by burglary tools, the leverage profile 28 causes the axial coupling to open. This is disclosed in detail in patent document DE 44 08 910.

Figure 2:
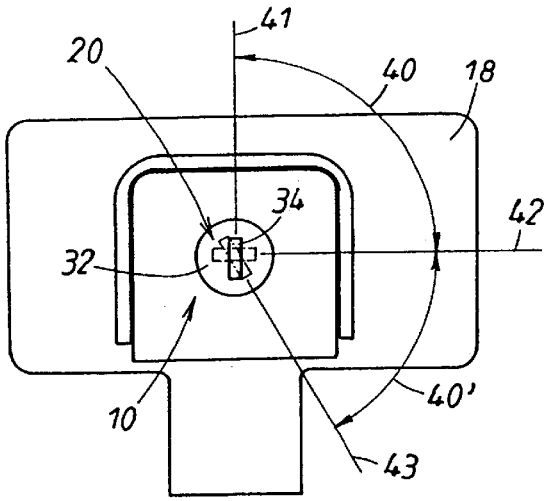
FIGS. 2 and 3 a front view and a back view of the device illustrated in FIG. 1, viewed respectively in the direction indicated with II and III.

In this way, the pusher 10 can be divided, on the one hand, into radially inner core parts 11 which are normally rotatable by the key 14 and which include the cylinder core 21 as well as the bolt 23. The core part 11 comprises also the cylinder head parts 32 at the forward end face which surrounds the opening 34 of the key channel and which provides reinforcement. The components of the core parts 11 can be moved by the two key rotations 40 of, for example, 90° and 40' of, for example, 60° between three rotational positions 41, 42, 43 which are illustrated in FIG. 2 with the aid of the three rotational positions of the key channel opening 34.

Furthermore, the pusher 10 can be divided into radially outer sleeve parts 12 which serve for receiving the aforementioned core parts 11 and which include firstly the aforementioned cylinder guide 22 and the bolt guide 24. Also included is a bushing 13 which projects axially past the cylinder guide 22 and the bolt guide 24 and is provided with a flange member 17 at its end. The aforementioned free spring 29 is supported between the flange member 17 and an inner collar of the bolt guide 24. The bushing 13 is provided with a cover 35 at its face that is showing and is received in a housing 18 so as to be axially slidable but not rotatable. The housing 18 is mounted with cellular rubber seals in a door panel 19 indicated in dash-dotted lines in FIG. 4.

Figure 3:
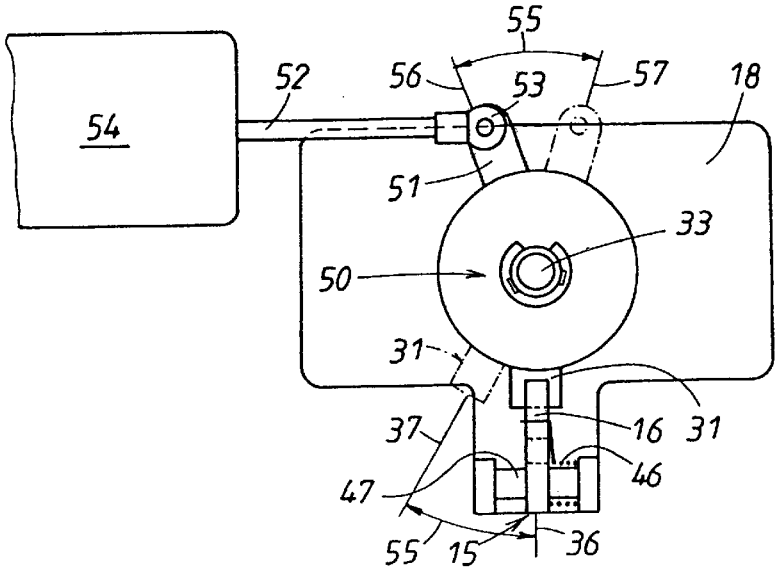
Figure 4:
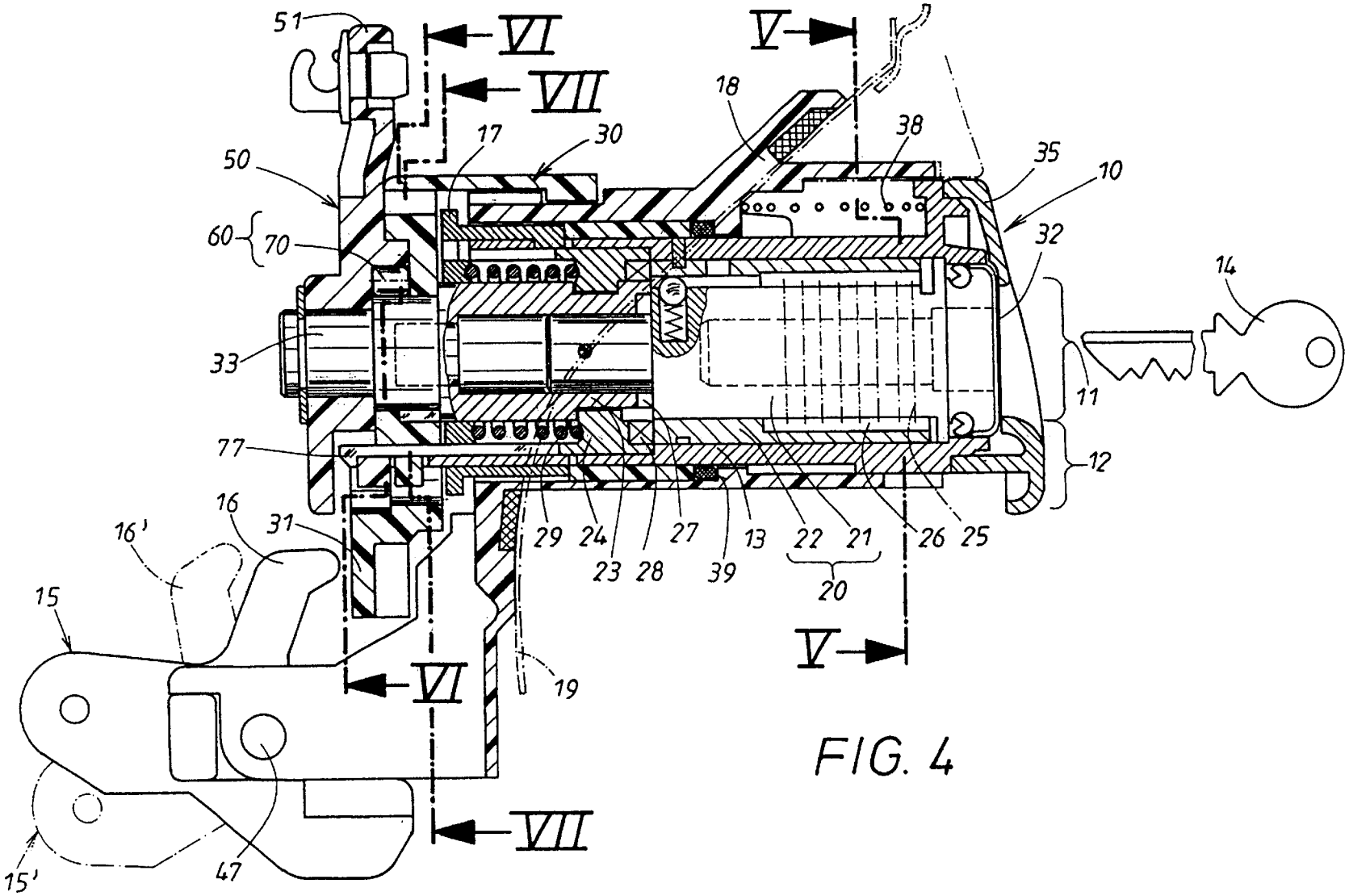
FIG. 4 an axial section of the device of FIG. 1.
Figure 5:
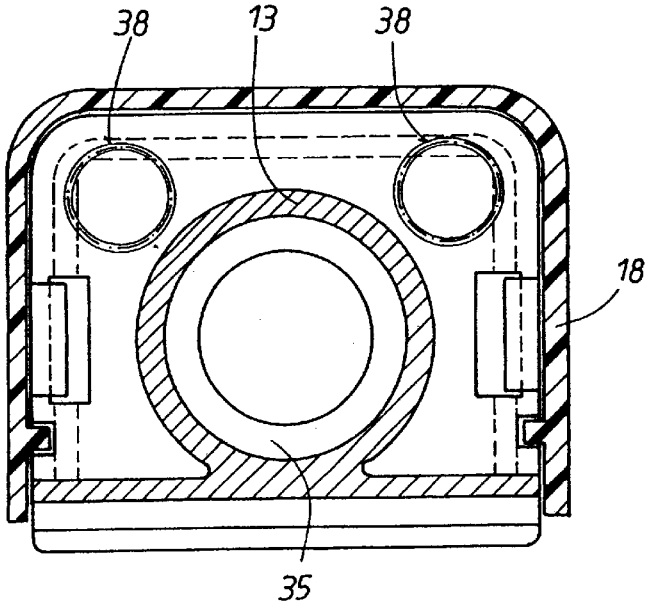
FIG. 5 a cross-sectional view of the device of FIG. 4 along the section line V—V wherein the central components have been omitted.

At the inner end of the sleeve part 12 a pusher base 30 is positioned which is provided with a pusher arm 31. The bolt end 33 of the corresponding bolt 23 being part of the core parts 11 is used for its support. As can be seen in FIG. 3, a rotation of the core parts 11 rotates the pusher arm 31 between two angular positions 36, 37. In a first position 36, shown in solid lines in FIG. 3, the pusher arm 31 is axially aligned relative to an actuator arm 16, best seen in FIG. 1, that is a part of the aforementioned first locking element 15 which in the present case is a deflecting lever. As can be seen in FIGS. 4 and 5, the pusher 10 is normally secured in its extended position, shown in solid lines in FIGS. 1 and 4, by two pusher springs 38 which are supported on end faces of the cover 35 and the housing 18. This position is defined by the inner stops 39 between the bushing 13 and the housing 18.

Upon axial actuation of the pusher 10 with a finger in the direction of the arrow 80, as can be seen in FIG. 1, the bolt end 33 is moved into the inserted position 33' represented by dash-dotted lines. The pusher base 30 is entrained so that its pusher arm 31 is moved into the inserted position 31' also shown in dash-dotted lines. In the aforementioned angular position 36 of FIG. 3 the pusher arm 31' contacts the working arm 16 of the deflecting lever 15 and moves this arm into the operational position 16' illustrated in dash-dotted lines in FIGS. 1 and 4. The deflecting lever is thus pivoted into its operational position 15' shown in dash-dotted lines and carries out a movement illustrated by the actuating arrow 45, for example, via the rod 44 indicated in FIG. 1 acting onto the locking elements of the device (not shown). The angular position 36 of the pusher arm 31 is thus an active position of the pusher base 30.

However, when the second angular position 37, shown in a dash-dotted line in FIG. 3, of the pusher base 31 is present, then the dash-dotted pusher arm 31 does not contact the operational arm 16 of the deflecting lever 15. Thus, no actuation of the locking elements occurs. Accordingly, the angular position 37 is an "inactive position" of the pusher arm 31.

As can be seen in FIGS. 1, 3, and 4, the deflecting lever 15 is rotatably supported at 47 on a projection of the housing 18. A return spring 46 returns the deflecting lever from the operational position 15' again into its rest position 15 of FIGS. 1 or 4. At the inner bolt end 33 of the pusher lever 51 is furthermore rotatably supported with its lever base 50. This lever 51 is connected by a joint bracket 53 with a pusher member 52 of the already aforementioned CL drive 54 of a central locking device cooperating with the device, so that the lever 51 in the following will be referred to as "CL lever". The CL lever 51 itself can be pivoted between the two pivot positions 56, 57 indicated with 56, 57 in FIG. 3. The pivot angle 55 between these two positions 56, 57 is identical with the pivot angle between the two aforementioned angular positions 36, 37 of the pusher arm 31. This will be explained in more detail with the aid of FIGS. 8*a* and 8*b*.

Figure 7A:
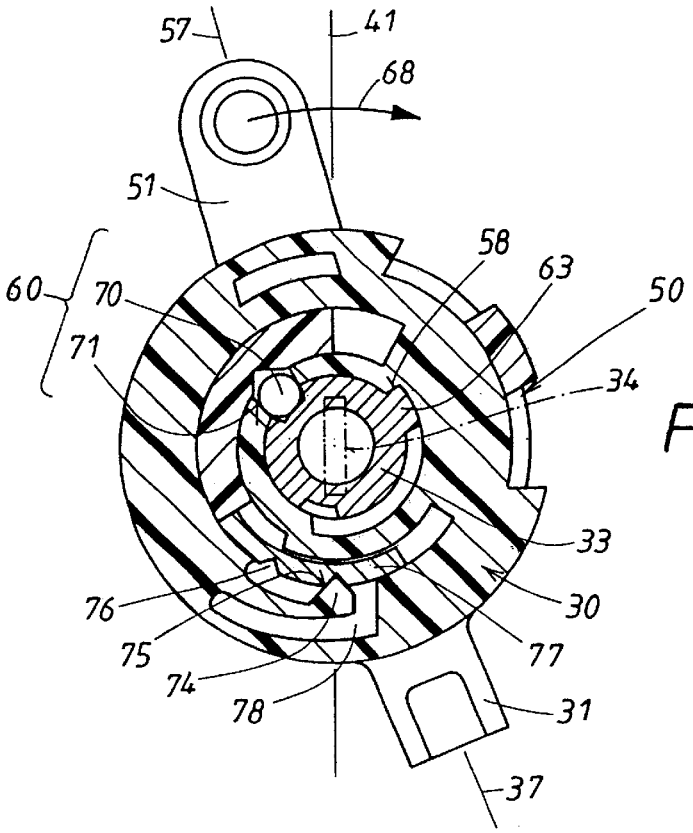
FIGS. 7*a* and 7*b* a further cross-section of the device along the section line VII—VII of FIG. 4, wherein the components are shown in two different operational positions when the core parts of the device are in a first rotational position, i.e. in the aforementioned secured position.
Figure 7B:
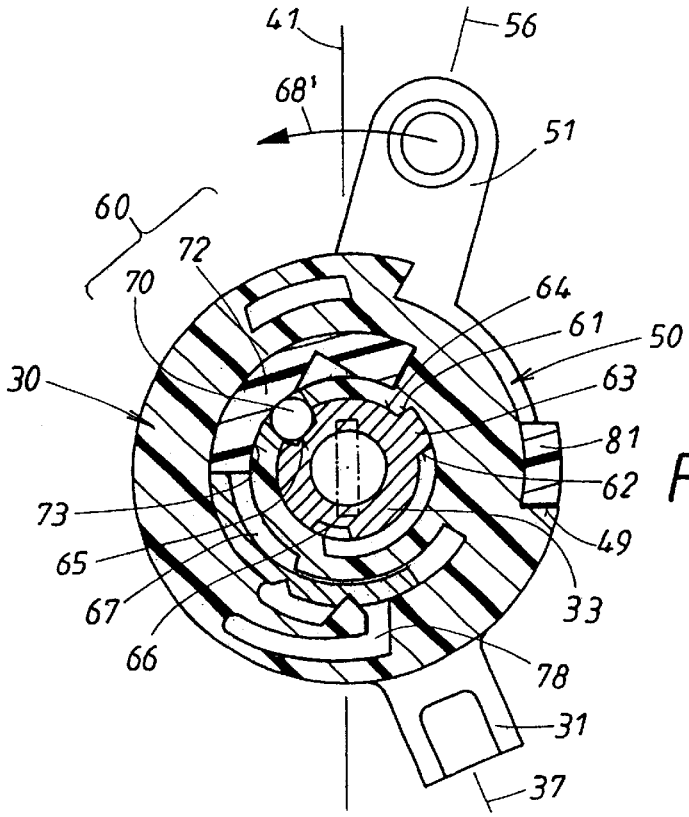
Figure 8A:
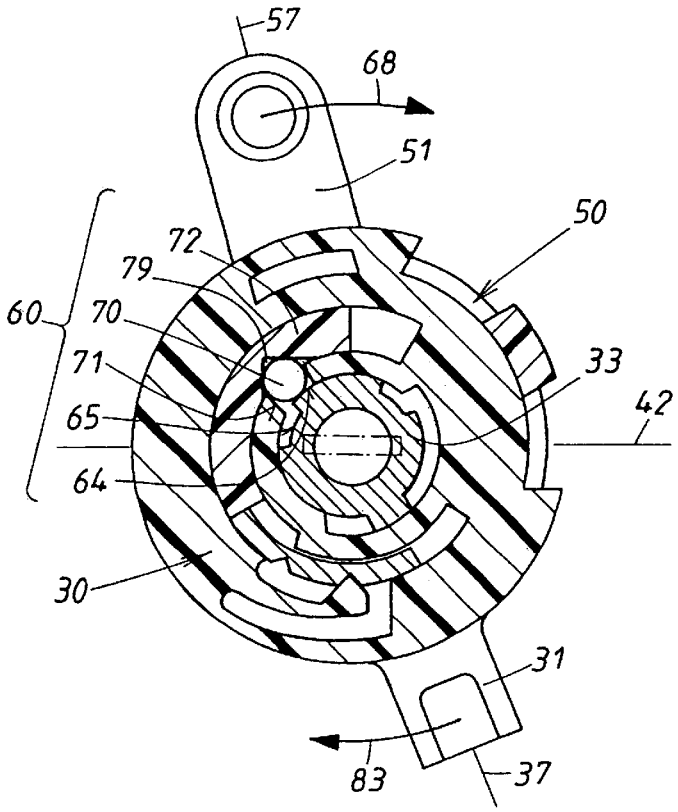
FIGS. 8*a* and 8*b* show the corresponding cross-sections in two further operational positions of the components when the core parts are in a second rotational position, i.e., their "normal position"
Figure 8B:
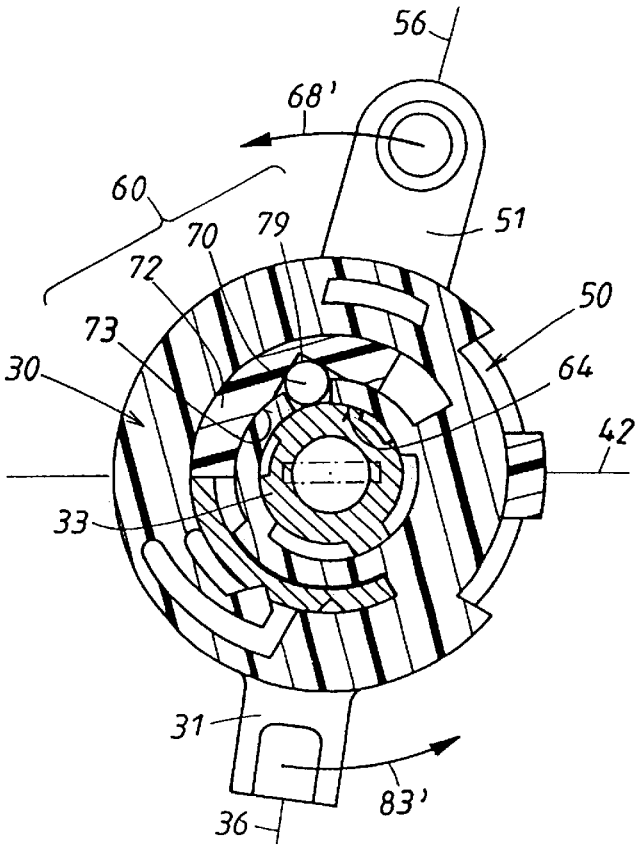

A particularity of the invention is that between the lever base 50 and the pusher base 30 special coupling means 60 are arranged which are switched between the coupling-active position according to FIGS. 8*a* and 8*b*, on the one hand, and the coupling-inactive position of FIGS. 7*a*, 7*b* by key activation of the core parts 11 of the pusher 10. The coupling means 60 have in the shown embodiment the following special construction as will be explained in connection with FIG. 7*a*.

In FIG. 7*a* the core parts 11 are in a rotational position 41 which is determined by a vertical position of the key channel opening 34. This refers to the already aforementioned "secured position". It is firstly characterized in that the pusher arm 31 is in the aforementioned inactive position 37. This angular position 37 is fixed by blocking of the pusher base 30. For this purpose, a cam 63, shown in FIG. 7*b*, is provided which has two flanks 61 and 62.

The cam 63 projects radially past the circumferential surface 64 of the bolt 23. One of its flanks 61 forms a radial shoulder 61 which in the secured position 41 rests at a counter shoulder 58 of the pusher base 30 shown in FIG. 7*a*. This counter shoulder 58 is one end of an annular recess 69 provided at the pusher base 30 which is provided in the area of the bearing location on the bolt 33. This prevents a movement of the pusher arm 31 by burglary tools from its inactive position 37 into an active position 36 which is, for example, illustrated in FIG. 8*b*. Furthermore, in the secured position of FIGS. 7*a*, 7*b* such a movement of the pusher arm 31 via the CL lever 51 is not possible because of the already mentioned inactive position of the coupling means 60.

The coupling means comprise, as will be explained with the aid of FIG. 7*a*, a radial guide 71 in the pusher base 34 for a coupling member 70 which in the present case has a round profile and is comprised of a roll. The diameter of the roll 70 is greater than the radial dimension of the guide 71. The circumferential surface 64 has depressions at two defined locations in the form of a respective groove 65 and 66. In the secured position 41, the first groove 65 is radially aligned with the roll 70 in the pusher base 30, and the roll is forced into the groove 65 by the counter control surface 73 illustrated in FIG. 7*b*. This counter control surface 73 belongs to a ring segment 72 seated on the lever base 50 which projects into an annular recess 67 in the pusher base 30. The CL lever 51 can now be pivoted by the LC drive 54 of FIG. 3 between the two pivot positions 56, 57, illustrated in FIGS. 7*a* and 7*b*, but because of the radially depressed position of the roll 70 the adjusting movement 68 and 68' between the two positions 56, 57 is not transmitted onto the pusher arm 31. The pusher arm 31 remains instead in the inactive position 37 illustrated in FIGS. 7*a* and 7*b*.

This inactive angular position 37 can be determined by catch elements 74, 75, illustrated in FIG. 7*a*, which are comprised of a springy catch tooth 74 at the pusher base 30 and a complementary catch notch 75 at the sleeve part. The sleeve part 12 with the catch notch is in the form of an axial extension 77 of the bolt guide 24, illustrated in FIG. 4, which engages a cutout 78 of the pusher base 30.

Figure 6:
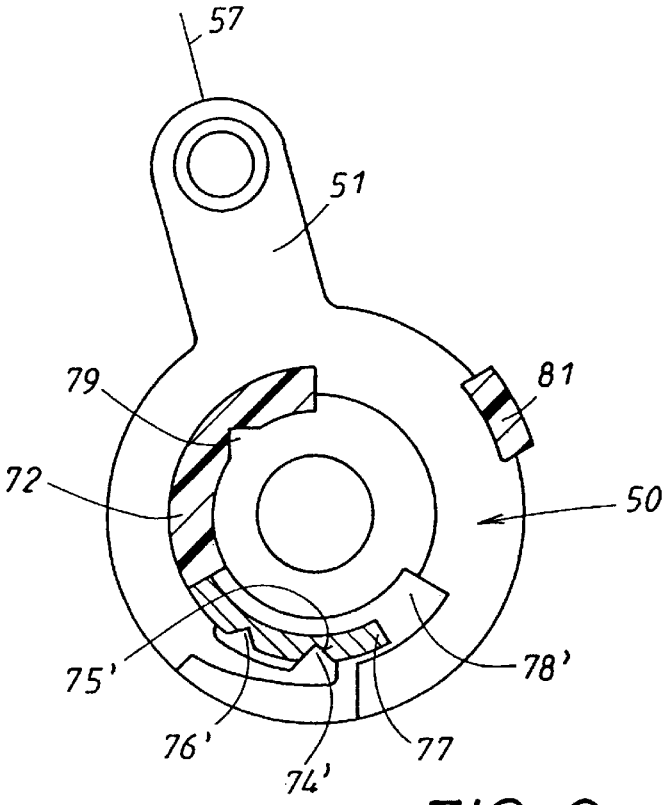
FIG. 6 a cross-section of the device along the section line VI—VI of FIG. 4 with omission of some components.

Similar catch elements 74' through 76' act, according to FIG. 6, on the lever base 50. The lever base 50 also has a cutout 78' for the axial extension 77 of the sleeve part 12 of the pusher 10. The lever base 50 has a springy catch tooth 74' which engages selectively one of the two catch notches 75', 76' of the sleeve extension 77 when the lever 51 is moved by the CL drive 54 according to the movement arrows 68, 68' between its two pivot positions 57, 56, represented in FIGS. 7*a* and 7*b*. The pivot positions 56, 57 can be determined by the rotational end stops between the lever base 50 and the pusher base 30. For this purpose, an axial projection 81 seated on the lever base 50 can be used which cooperates in the pivot position 56 of the CL lever 51 with a first end face 49 of the pusher base 30.

When the core part 11 is moved by the key into its second rotational position 42, which is defined as the "normal position", the coupling means 60, as has been mentioned before, are positioned in their active coupling position. In the shown embodiment, this is achieved by a different radial position of the roll 70 which is achieved by the aforementioned radial stepping of the control surfaces 64, 65, 66 at the bolt end 33.

As shown in FIG. 8*a*, in the normal position 42 the groove 65, which in the secured position of FIG. 7*b* is active for receiving, is rotated away. Upon rotation about the angle 40 in FIG. 2 a slanted surface has become active at the limitation of the groove 65 so that the roll 70 is radially lifted in its radial guide 71. In FIG. 8*a*, it is already on the circumferential surface 64 of the bolt end 33 and projects into a radial cutout 79 which, as shown in FIG. 8*b*, is provided in the radially inwardly facing surface 73 of the ring segment 72. This provides a fixed coupling for common rotation between the pusher base 30 and the lever base 50.

When in this normal position 42 of the bolt end 33 the CL lever 51 is moved by the CL drive 54 of FIG. 3 in the sense of the movement arrows 68, 68' illustrated in FIGS. 8*a* and 8*b* between its two positions 56, 57, then the pusher arm 31 is entrained and performs analog movements illustrated by arrows 83, 83'. Even when the CL lever 51 is moved into the pivot position 56 illustrated in FIG. 8*b*, the roll 70 remains in engagement at the recess 79 because of the controlling circumferential surface 64. The coupling means 60 still remains in its active position. Accordingly, the pusher arm 31 is in its active angular position 36. Accordingly, the corresponding pivot position 56 of the CL lever 51 is still an "unsecured position" because then, as already disclosed in connection with FIGS. 1 and 3, an actuation of the pusher 10 in the direction of arrow 80 results in an actuation 45 of the locking element 15. However, when in the normal position 42 of the bolt end 33 the CL lever 51 is in the other pivot position 57, the afore-described inactive position 37 of the pusher arm 31, which is fixedly coupled thereto for common rotation, is present. This pivot position 57 is thus the "secured position" of the CL lever 51.

Figure 9:
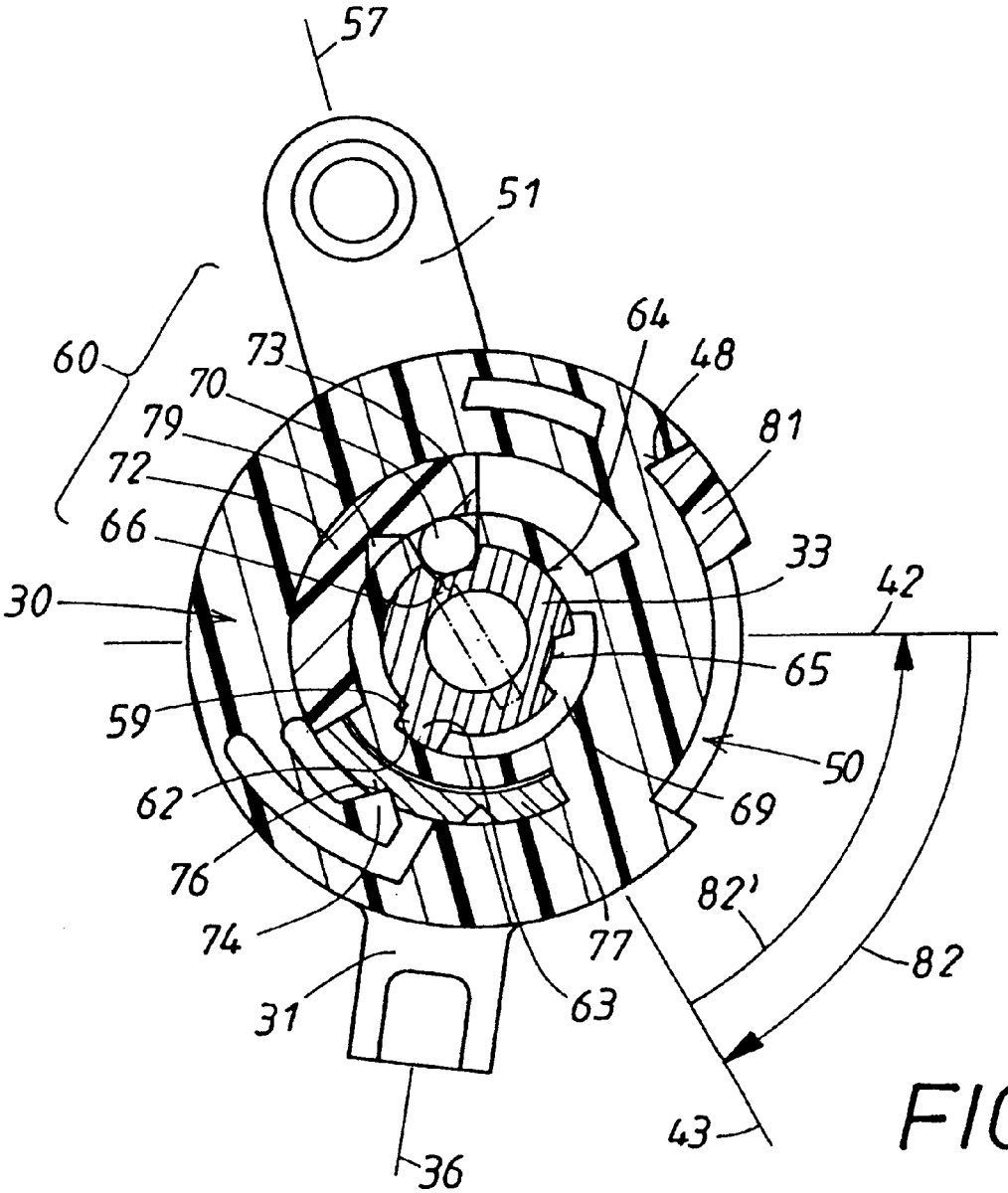
FIG. 9 shows in a representation corresponding to that of FIG. 8*a* a fifth operational position of the components in a third rotational position of the core parts, i.e., a "special position".

As already mentioned in connection with FIG. 2, the closing cylinder 20 can be moved by the key also into a third rotational position 43 by which the bolt end 33 is moved into its rotational position 43 illustrated in FIG. 9. This position is referred to in the following as "special position". This special position 43 is of interest when the vehicle via the CL device has been transferred into the secured position for all different locking devices, including the respective device at the rear of the vehicle. The vehicle is parked. Then, as already described before, the CL lever 51 is in the secured position 57 illustrated in FIG. 9. This is the secured position of FIG. 7*a* in which the pusher arm 31 is in the inactive position 37. It may happen that the owner of the vehicle wants to open the trunk, for example, in order to remove something from the vehicle. For this purpose, it is sufficient to move the closing device at the rear of the vehicle with the key into its special position 43 in order to open the trunk lid of the vehicle. When this is performed, as illustrated in FIG. 9, the secured locks of the other closing devices of the vehicle remain in their secured position. No switching of the CL device takes place. The CL lever 51 also remains in its secured position 57 in this special position 43 of FIG. 9 of the closing device.

The rotational actuation of the bolt end 33 indicated by 82 in FIG. 9 moves the cam 63 with its other flank 62 against a radial counter stop surface 59 of the pusher base 30. This counter stop surface 59 is positioned at the other end of the annular recess 69. Upon rotation 82 the pusher base 30 is also rotated by the cam 63 until its pusher arm 31 is moved into the active angular position 36 illustrated in FIG. 9. Then an actuation 80 of the pusher 10 in the direction of arrow 80 of FIG. 1 is again effective. This results in an actuation 45 of the locking element 15. This rotation 82 results automatically in a decoupling between the pusher base 30 and the lever base 50 which can be seen from the position of the coupling means 60 illustrated in FIG. 9.

Upon rotation 82 the circumferential surface 64 of the bolt end 33 has been rotated to such an extent until the aforementioned second groove 66 in the bolt end 33 is radially aligned with the roll 70. At the same time, the radial recess 79 has been moved away from the roll 70 until the radially inwardly projecting counter control surface 73 of the ring segment 72 forces the roll 70 into the groove 66. This results in a similar decoupling position of the coupling means 60 as in the secured position 41 of FIGS. 7*a*, 7*b* but with the difference that now the second groove 66 serves for receiving the roll 70 instead of the first groove 65 provided thereat.

The aforementioned axial projection 81 and the lever base 50 can cooperate with a second end face 48 of the pusher base 30, see FIG. 9, so that the pivot position 57 of the CL lever 51 is limited. Also, the afore-described catch elements secure the respective positions 36, 57 of the pusher arm 31, respectively, the CL lever 51. As shown in FIG. 9, the springy catch tooth 74 of the pusher base 30 engages the second catch notch 76 of the axial sleeve extension 77.

While the secured position 41 and the normal position 42 are rest positions of the core parts 11 of the pusher 10, wherein the key 14 can be inserted into the cylinder core 21 or removed therefrom, this is not the case in the special position 43 of FIG. 9. Upon counter rotation 82' by an angular amount of approximately 30°the roll 70 first reaches alignment with the recess 79 of the lever base 50. Because of the roll 70, a rotational entrainment of the pusher base 30 with the bolt end 33 occurs. Accordingly, the aforementioned inactive position 37 of the pusher arm 31 as shown in FIG. 8*a* is reached. Upon further return rotation 82' of FIG. 9, the roll 70 is then forced from the second groove 66 via the slanted surfaces of the groove and is forced outwardly into the now aligned recess 79 by the now control-active circumferential surface 64. The coupling between the pusher arm 31 and the LC lever 51 is again achieved. The coupling means 60 are again in the active position illustrated in FIG. 8*a*.

List of Reference Numerals

| | |
|---|---|
| 10 | pusher |
| 11 | core part of 10 |
| 12 | sleeve part of 10 |
| 13 | bushing for 22, 24 of 12 |
| 14 | key |
| 15 | first locking element, deflecting lever (rest position) |
| 15' | operational position of 15 |
| 16 | working arm of 15 (rest position) |
| 16' | operational position of 16 |
| 17 | flange member of 13 |
| 18 | housing for 10 |
| 19 | door panel |
| 20 | closing cylinder |
| 21 | cylinder core of 20 |
| 22 | cylinder guide of 20 |
| 23 | extension of 21, bolt |
| 24 | extension of 22, bolt guide |
| 25 | lock elements in 21 |
| 26 | lock channel in 22 |
| 27 | axial coupling between 21, 23 |
| 28 | leverage profile between 22 and 24 |
| 29 | freely moving spring for 24 |
| 30 | pusher base |
| 31 | pusher arm of 30 (extended position) |
| 31' | inserted position of 31 |
| 32 | head part of cylinder |
| 33 | bolt end of 23 (extended position) |
| 33' | inserted position of 33 |
| 34 | key channel opening |
| 35 | cover of 13 |
| 36 | first angular position of 31, active position |
| 37 | second angular position of 32, inactive position |
| 38 | pusher spring for 10 |
| 39 | inner stop between 10 and 18 |
| 40 | rotation between 41, 42 |
| 40' | rotation between 42, 43 |
| 41 | first rotational position of 11 or 33, secured position (FIGs. 7a, 7b) |
| 42 | second rotational position of 11 or 33, normal position (FIGs. 8a, 9b) |
| 43 | third rotational position of 11 or 33, special position (FIG. 9) |
| 44 | rod on 15 (FIG. 1) |
| 45 | actuation arrow of the locking element (FIG. 1) |
| 46 | return spring for 15 (FIG. 3) |
| 47 | rotary bearing of 15 |
| 48 | one end face of 30 for 81 |
| 49 | other end face of 30 for 81 |
| 50 | lever base of 51 |
| 51 | CL lever of 50 |
| 52 | push member of 54 for 51 |
| 53 | joint bracket between 51, 52 (FIG. 1) |
| 54 | CL drive (FIG. 3) |
| 55 | pivot angle between 36, 37 or 56, 57 |
| 56 | first pivot position of 51, unsecured position |
| 57 | second pivot position of 51, secured position |
| 58 | radial counter shoulder for 61, first end of 69 |
| 59 | counter stop surface for 62, second end of 69 |
| 60 | coupling means between 30, 50 |
| 61 | first flank, radial shoulder of 63 |

-continued

List of Reference Numerals

| | |
|---|---|
| 62 | second flank, radial stop surface of 63 |
| 63 | radial cam on 33 |
| 64 | control surface on 33, circumferential surface |
| 65 | control surface on 33, first groove |
| 66 | control surface on 33, second groove |
| 67 | annular recess in 30 for 72 |
| 68 | arrow of movement of 51 from 57 into 56 |
| 68' | arrow of movement of 51 from 56 into 57 |
| 69 | annular recess in 30 |
| 70 | coupling member of 60, roll |
| 71 | radial guide in 30 for 70 |
| 72 | ring segment of 50 |
| 73 | counter control surface on 72 for 70 (FIG. 7b) |
| 74 | catch element on 30, spring catch tooth (FIG. 7a) |
| 74' | catch element on 50, spring catch tooth (FIG. 6) |
| 75 | catch element on 30, first catch notch for 74 on 77 (FIG. 7a) |
| 75' | catch element on 30, first catch notch for 74' (FIG. 6) |
| 76 | catch element on 30, second catch notch on 77 for 74 |
| 76' | catch element on 50, second catch notch for 74' on 77 (FIG. 6) |
| 77 | axial sleeve extension on 24 for 75 to 76' |
| 78 | cutout in 30 (FIG. 7a) |
| 78' | cutout in 50 (6) |
| 79 | radial recess in 72 (FIG. 6) |
| 80 | actuation arrow of 10 (FIG. 1) |
| 81 | axial projection on 50 (FIG. 6) |
| 82 | rotational actuation arrow of 33 between 42 and 43 (FIG. 9) |
| 82' | counter rotation arrow of 33 between 43 and 42 (FIG. 9) |
| 83 | arrow for adjusting movement of 31 (FIG. 8a) |
| 83' | arrow for adjusting movement of 31 (FIG. 8b) |

What is claimed is:

1. Closing device with a key-actuated closing cylinder (20) which is at the same time a component of a pusher (10) and serves as a pusher device for actuating locking elements (19) for closing functions at the rear of a vehicle, the vehicle comprising additional closing devices with locks in addition to the closing device with the key-actuated closing cylinder, wherein:

the closing cylinder (20) is comprised of a cylinder core (21) with lock elements (25) controlled by a key (14) and of a cylinder guide (22) for rotary support of the cylinder core (21) with locking receiving elements (26) for the lock elements (25);

the pusher (10) is divided into radially inner core parts (11) and outer sleeve parts (12) receiving them, and the core parts (11), which comprise at least the cylinder core (21), can be moved by the key (14) at least between two rotational positions (41, 42), while the sleeve parts (12), which comprise at least the cylinder guide (22), are axially movable in a stationary housing (18) and are loaded by an axial spring force (38) in the outward direction;

at the inner end of the pusher (10) a pusher base (30) is rotatably supported which is axially movable upon pushing (80) and comprises a pusher arm (31);

the pusher base (30) with the pusher arm (31) is movable between first and second angular positions (36, 37) acting differently with respect to a first locking element (15) to be actuated, the first angular position (36) being aligned with the first locking element (15) and thus being an active position (36) during pushing (80) and the second angular position (37) being non-aligned and an inactive position (37) during pushing (80);

a lever base (50) of a central locking lever (LC lever 51) is rotatably supported adjacent to the pusher base (30) on the inner end of the pusher (10) and coupling means (60) are arranged between the two bases (30, 50), which are switched active and inactive by the core parts (11) of the pusher (10) as a function of the key-actuated rotational position (41, 42);

the CL lever (51) is connected to the drive (CL drive 54) of a central locking device (CL device) of the vehicle configured to control the additional closing devices of the vehicle;

the CL lever (51) can be pivoted by the CL drive (54) between first and second pivot positions (56, 57), the first pivot position (56) being a secured pivot position, in which at least the locks of the additional closing devices cannot be actuated by the CL device, and the second pivot position (57) being an unsecured pivot position, in which these locks can be actuated;

only in one rotational position (normal position 42) of the core part (11) the coupling means (60) are active and couple the pusher base (30) and the lever (50), while in the other rotational position (secured position 41) of the core parts (11), in which the pusher arm (31) is in the inactive position (37), the coupling means (60) are inactive and decouple the pusher base (30) from the lever base (50).

2. Device according to claim 1, wherein in the secured position (41) of the core parts (11) the pusher base (30) is blocked against rotation and the pusher arm (31) cannot be moved into the active position (36).

3. Device according to claim 2, wherein the core parts (11) have a radial shoulder (61) which in the secured position (41) rests at a radial counter shoulder (58) of the pusher base (30).

4. Device according to claim 3, wherein:

the pusher base (30), respectively, the lever base has a radial guide (71) for a coupling member (70);

the coupling member (70) is moved in the guide (71) by control surfaces (64, 65, 66), provided at the core parts (11), between two different radial positions;

the coupling member (70) only in one of the radial positions, which is present in the normal position (42) of the core parts (11), engages partially a recess (79) in the lever base (50) or pusher base and provides thus a fixed connection for common rotation between the lever base (50) and the pusher base (30), while in the other radial position, which is present in the secured position (41) of the core parts (11), the coupling member (70) is positioned external to the recess (79) so that the lever base (50) is freely rotatable relative to the pusher base (30).

5. Device according to claim 3, wherein:

the control surfaces (64, 65, 66) are radially stepped in the core parts (11);

the core parts (11) comprise a bolt (23, 33) axially extending the cylinder core (21) and the control surfaces are comprised of the circumferential surface (64) of the bolt (23, 33) and of a groove (65) radially extending therein;

the bolt (23, 33) serves as a rotational support of the pusher base (30) and of the lever base (50);

the lever base (50) or the pusher base engages with a ring segment (72) an annular recess (67) of the pusher base (30) or lever base at a location where the radial guide (71) for the coupling member (70) is provided;

the ring segment (72) provides a counter control surface (73) cooperating with a loose coupling member (70) in which the recess (79) is provided;

the coupling member (70) upon key actuation is forced either by the circumferential surface (64) of the bolt (23, 33) partially into the recess (79) of the ring segment (72) or by the counter control surface (73) of the annular segment (72) partially into the groove (65) of the bolt (23, 33).

6. Device according to claim 3, wherein, based on the normal position (41), where the CL lever (51) is in its secured position (57) and the pusher arm (31) in the inactive position (37), the core parts (11) are movable (40') into a third rotational position (special position 43) by the key (14) wherein the lever base (50) is also decoupled from the pusher base (30), and wherein the core parts (11) have a radial stop surface (62) for a radial counter stop surface (59) at the lever base (50) or the pusher base, with which the pusher arm (31) is moved from the inactive (37) into the active position (36).

7. Device according to claim 6, wherein also in the special rotational position (43) the control surfaces (66) on the core parts (11) move the coupling member (70) into a radial position, where the coupling member (70) is external to the recess (79) in the lever base (50) or pusher base.

8. Device according to claim 6, wherein the control-active circumferential surface on the bolt (23, 33) axially extending the cylinder core have a further radially extending groove (66), wherein this further groove (66) in the special rotational position (43) of the core parts (11) is radially aligned with the coupling member (70) and wherein the counter control surfaces (73) at the ring segment (72) of the lever base (50) or the pusher base continue to force the coupling member (70) in the special rotational position (43) into this further groove (66).

9. Device according to claim 5, wherein between the groove (65) or the grooves (65, 66) and the circumferential surface (64) on the bolt (23, 33) and/or between the counter control surface (73) and the recess (79) slanted surfaces for a radial movement component of the coupling member (70) upon rotational movement (40, 40') of the core parts (11) are provided.

10. Device according to claim 4, wherein the coupling member (70) has around profile and is especially a roll.

11. Device according to claim 3, wherein the radial shoulder (61) and the radial stop surface (62) are formed by the two flanks of a cam (63) seated on the bolt (23, 33) and projecting past the circumferential surface (64) and wherein the counter shoulder (58) and the counter stop surface (59) are formed by the ends of an annular recess (69) in the lever base (50) or the pusher base which is arranged in the area of the bearing locations.

12. Device according to claim 1, wherein the active and/or inactive position (36, 37) of the pusher arm (31) or the unsecured and/or secured position (56, 57) of the CL lever (51) are secured by catch elements (74 through 76) which are positioned between the pusher base (30) or the lever base (50) and the sleeve part (12) of the pusher (10).

13. Device according to claim 1, wherein between the lever base (50) and the pusher base (30) rotational stops (81, 48, 49) are arranged which in certain orientations or positions prevent a further rotation of the pusher arm (31) and/or of the CL lever (51).

14. Device according to claim 1, wherein the sleeve parts (12) of the pusher (10) in addition to the cylinder guide (22) have a bolt guide (24), axially extending them, for the bolt (23) of the core parts (11), wherein the bolt guide (24) is axially movable but non-rotatably guided in the housing (18), and wherein the bolt guide (24) is forced by an axial spring force (29) against the cylinder guide (21), wherein between the bolt (23) and the cylinder core (21) an axial coupling (27) and between the cylinder guide (22) and the bolt guide (24) an axial leverage profile (28) is arranged which upon forced rotation of the closing cylinder (20) causes an axial decoupling of the bolt (23).

15. Device according to claim 1, wherein the sleeve parts (12) of the pusher (10) comprise a bushing (13) which is axially movable but non-rotatably guided in the housing (18), and wherein the bushing (13) extends axially across the cylinder guide (22) and across the bolt guide (24).

* * * * *